United States Patent [19]

Raubenheimer

[11] Patent Number: 4,560,418

[45] Date of Patent: Dec. 24, 1985

[54] WHEELED SUCTION CLEANERS

[75] Inventor: Johann N. Raubenheimer, Bedfordview, South Africa

[73] Assignee: Peacock Investments (Proprietary) Limited, Johannesburg, South Africa

[21] Appl. No.: 532,176

[22] Filed: Sep. 14, 1983

[30] Foreign Application Priority Data

Sep. 20, 1982 [ZA] South Africa ..... 82/6889

[51] Int. Cl.[4] ..... B08B 5/04

[52] U.S. Cl. ..... 134/18; 15/1.7; 134/21; 134/22.1

[58] Field of Search ..... 15/1.7; 134/18, 21, 134/22.1; 210/169, 242.1

[56] References Cited

U.S. PATENT DOCUMENTS 3,803,658 4/1974 Raubenheimer ..... 15/1.7

3,928,202 12/1975 Raubenheimer ..... 15/1.7

4,434,519 3/1984 Raubenheimer ..... 15/1.7

FOREIGN PATENT DOCUMENTS 484015 7/1975 Australia ..... 15/1.7

*Primary Examiner*—Richard V. Fisher

*Assistant Examiner*—W. Gary Jones

*Attorney, Agent, or Firm*—Ladas & Parry

[57] ABSTRACT

A wheeled suction cleaner with endless tracks is driven by a turbine actuated by water flowing through the cleaner. To enable the cleaner to be steered, the turbine also drives an eccentric mass which momentarily lessens the adhesion of the cleaner to the surface on which it works. Steering is effected by a motor also driven by water flowing through the device which intermittently and at intervals turns a spigot on the cleaner which is connected to a flexible suction hose.

8 Claims, 1 Drawing Figure

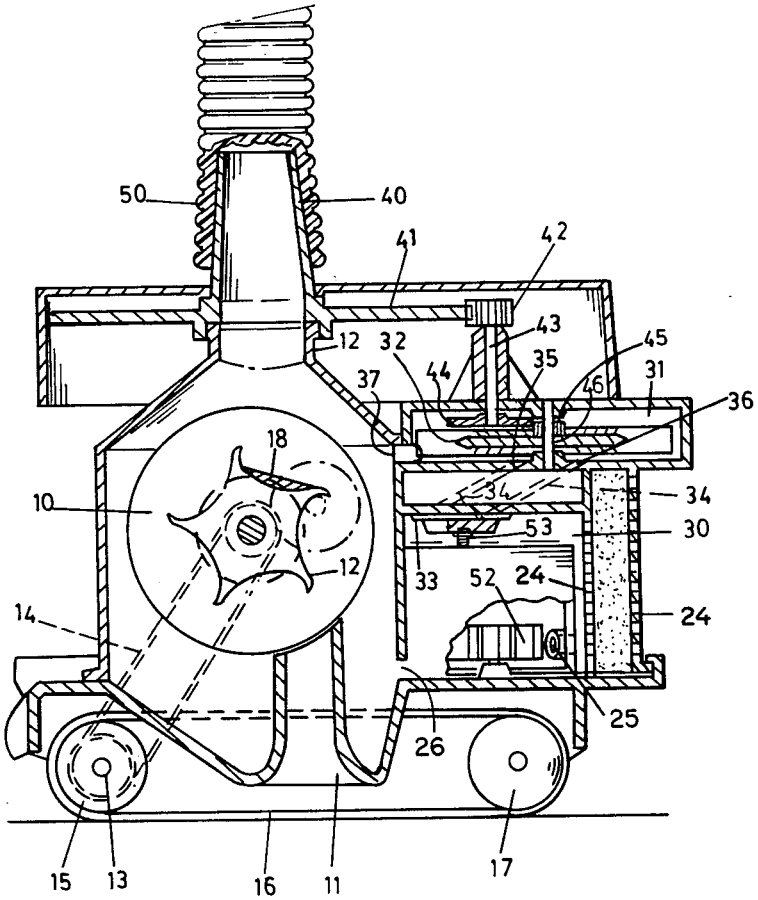
50
40
41
42
43
12
32
45
35
44
31
37
46
36
18
34
10
34
53
30
12
33
52
24
14
24
25
26
15
13
16
11
17

WHEELED SUCTION CLEANERS

BACKGROUND OF THE INVENTION

This invention relates to wheeled suction cleaners for cleaning submerged surfaces.

Cleaners of the kind in question are known. They may have a set of wheels of which at least one pair is driven or they may have endless tracks for propulsion along the submerged surface. The driving power is obtained from a turbine or water motor powered by the liqud flowing through the cleaner.

Cleaners of the kind in question are held to a surface to be cleaned by the suction force of the liquid being drawn into the cleaner. With the strong adhesion of the cleaner to the surface due to suction and the necessity for traction between the wheels or endless track and the surface, it is difficult to cause such a cleaner to be steered. Such devices have in the past not been successfully steered.

SUMMARY OF THE INVENTION

The present invention provides a method of applying steering forces to a wheeled suction head for cleaning submerged surfaces which suction head is connected to a suction system by means of a flexible suction hose, is connected to the hose along an axis normal to the surface to be cleaned and has wheels driven by a motor actuated by water flowing through the head to the hose, with the improvement of causing the rotor of the drive motor in addition to driving the wheels to drive an eccentric weight which imparts a rocking motion to the head, so that from time to time adhesion of the head to the surface is disturbed and any steering force can take effect more readily.

The invention also provides the further improvement of causing the flowing liquid to apply a torque about the axis of the suction hose at some zone along its length, which torque is used or released to turn the head about its connecting axis to the suction hose.

The torque may be applied alternately in opposed directions about the axis of the suction hose.

The zone at which the torque is applied is conveniently the connection of the hose to the cleaner head.

A suction cleaning head according to the invention comprises a housing with an inlet in its base and a connection normal to the base for connection to a suction hose;

a water driven turbine positioned in the path of liquid flowing from the inlet to the connection;

wheels on the housing supporting it for travel on the surface to be cleaned; and motion transmitting means between the turbine and at least one wheel; with the improvement of an eccentric weight driven by the turbine which imparts a rocking motion to the housing so that from time to time adhesion of the head to the surface is disturbed for any steering force to take effect more readily.

The head may further have a spigot serving as a connection for attachment to a suction hose and journalled for rotation relatively to the housing; a drive gear fast with the spigot; a bypass to the path of liquid flowing through the housing; a water turbine positioned in the bypass and caused to rotate by liquid flowing in the bypass, a gear train between the turbine and the drive gear and means for intermittently blocking and unblocking the bypass so that the turbine applies torque to the drive gear intermittently and for short periods of time.

The bypass may have two branches, each arranged to cause the turbine to rotate in another direction and with the branches are alternatively unblocked.

The blocking and unblocking device may be a valve plate driven at a slow speed by a water motor also actuated by water sucked through the connection.

DESCRIPTION OF THE DRAWING

It is a diagrammatic section through a cleaner according to the invention.

DESCRIPTION OF AN EMBODIMENT

In the drawing a suction head has a turbine chamber 10 with an inlet 11 and a turbine 12 in the chamber 10. The turbine drives a shaft 13 through a chain or belt 14. A pair of wheels 15 on the shaft 14 carry endless tracks which also extend over wheels 17 at the other end of the cleaner.

The device thus far described is no more than a known endless track suction cleaner. The first improvement provided by the invention is that there is a weight 18 carried by the rotor 12. As the weight 18 goes round it rocks the whole body of the cleaner so that the track 16 momentarily loses its grip on the surface on which it runs. It is thus possible for the steering mechanism described below to become operative. Attached to the chamber 10 are two compartments 30 and 31. In the upper compartment 30 there is a reversible turbine 32. Two inclined passages 34 port in the compartment 30 and in the compartment 31 at the ports 35 and 36. The ports in the compartment 31 are controlled by a valve plate 33 the operation of which will be described later on. The outlet from the compartment 31 is at 37. The compartment 31 is formed with two spaced perforated walls 24 between which is housed a filter medium such as stainless steel wool. Water can thus reach the ports in the compartment 31.

On the outlet 12 there is rotatably mounted a hose connection 40 which carries a large gear wheel 41 and is connected to a suction hose 50. A pinion 42 on a shaft 43 meshes with the gear wheel 41. At its lower end the shaft 43 carries a gear 44 which meshes with a pinion 45 on the shaft 46 of the turbine 32. If the turbine 32 rotates, it will thus apply a high slow speed torque to the connection 40.

In the compartment 31 there is also housed a water motor of the type used with oscillating sprinklers and geared down to give a reduction of the order of 2000:1. Water passing through the walls 34 enter the motor through an inlet 25 and passes into the housing 10 through an outlet 26. The rotor of the water motor has been shown as 52. The ultimate output of the motor 52 is at a shaft 53 which drives the valve plate 33 which is resiliently biased upwardly.

As the motor 52 rotates the valve plate 33 alternately covers and uncovers the ports 35 and 36 with relatively long periods when both ports are covered. As a port 35 and 36 is uncovered the turbine 32 applies a torque to the connection 40 which is in use attached to a flexible hose. The hose will resist the turning movement and the net effect is that the whole device turns around the axis of the connection 40. When the then open port is closed, the device will be facing a random new direction usually more or less opposite to its original direction. Of course, the running of the turbine 12 will constantly tend to move the device in its forward direction at any given time so that in turn a sort of spiral movement will take place.

Briefly then the rotation of the turbine 12 causes the track 16 to run in one direction from the device to move in that direction. Due to the weight 18 track adhesion is diminished periodically. The motor 52 runs continuously and from time to time opens a port 35 or 36 which causes the turbine 32 to apply a torque to the connection 40 and to cause a change of direction either to the left or to the right in the direction of movement while adhesion is diminished.

Alternatively or in addition the device described above, i.e. with the weight 18, may be steered by the method and means described in the U.S. patent application Ser. No. 422,160 filed Sept. 23, 1982 (now abandoned).

As a further alternative the device may be steered by driven means such as the turbine assembly described above acting at any point on the suction hose, for example, at the point where the hose is plugged into the permanent plumbing of the pool, or at a floating surface skimmer which forms another part of a system for cleaning the pool.

I claim:

1. A method of applying steering forces to a wheel-supported suction head for cleaning submerged surfaces which is connected to a suction system by means of a flexible suction hose, is connected to the hose along a connecting axis normal to the surface to be cleaned and has wheels driven by a drive motor actuated by liquid flowing through the head to the hose with the improvements of causing the liquid to flow continuously through the head to the hose, causing a rotor of the drive motor in addition to driving the wheels to continuously drive an eccentric weight which imparts a rocking motion to the head, so that from time to time adhesion of the head to the surface is disturbed and any steering force can take effect more readily, and intermittently applying a torque about the connecting axis.

2. The method of claim 1 with the further improvement of causing the flowing liquid to apply a torque about the axis of the suction hose at some zone along its length, which torque is used or released to turn the head about its connecting axis to the suction hose.

3. The method claimed in claim 2 in which torque is applied alternately in opposed directions about the axis of the suction hose.

4. The method claimed in claim 3 in which the zone at which the torque is applied is the connection of the hose to the cleaner head.

5. A suction cleaning head comprising: a housing with an inlet at its base and a connection with an axis normal to the base for connection to a suction hose; a first liquid driven turbine positioned in a path of liquid flowing from the inlet to the connection to be driven continuously without interrupting flow of liquid; wheels on the housing supporting it for travel on a surface to be cleaned; and motion transmitting means between the first turbine and at least one wheel; with the improvements of: an eccentric weight continuously driven by the first turbine which imparts a rocking motion to the housing so that from time to time adhesion of the head to the surface is disturbed for any steering force to take effect more readily; and means intermittently to apply a torque about the axis of the connection to serve as a steering force.

6. The cleaning head claimed in claim 5 having a further improvement of a spigot serving as a connection for attachment to a suction hose and journalled for rotation relatively to the housing, a drive gear fast with the spigot, a bypass to the path of liquid flowing through the housing, a second water turbine positioned in the bypass and caused to rotate by liquid flowing in the bypass, a gear train between the second turbine and the drive gear and means for intermittently blocking and unblocking the bypass so that the second turbine applies torque to the drive gear intermittently and for short periods of time.

7. The cleaning head claimed in claim 6 in which the bypass has two branches, each arranged to cause the second turbine to rotate in another direction and with which the branches are alternatively unblocked by a blocking and unblocking device.

8. The cleaning head claimed in claim 7 in which the blocking and unblocking device is a valve plate driven at a slow speed by a motor actuated by liquid sucked through the connection.

* * * * *